US010996013B1

(12) United States Patent
Bradley et al.

(10) Patent No.: US 10,996,013 B1
(45) Date of Patent: May 4, 2021

(54) RFID GUN LOCK

(71) Applicant: ARK TECHNOLOGIES, LLC, Port Washington, WI (US)

(72) Inventors: Jonathan Bradley, Port Washington, WI (US); Andrew Wasz, Bayside, WI (US)

(73) Assignee: Ark Technologies, LLC, Port Washington, WI (US)

( * ) Notice: Subject to any disclaimer, the term of this patent is extended or adjusted under 35 U.S.C. 154(b) by 0 days.

(21) Appl. No.: 16/574,746

(22) Filed: Sep. 18, 2019

Related U.S. Application Data

(60) Provisional application No. 62/813,405, filed on Mar. 4, 2019, provisional application No. 62/794,156, filed on Jan. 18, 2019.

(51) Int. Cl.
*F41A 17/44* (2006.01)
*F41A 17/06* (2006.01)

(52) U.S. Cl.
CPC ..... *F41A 17/44* (2013.01); *F41A 17/06* (2013.01)

(58) Field of Classification Search
CPC ..... F41A 17/44; F41A 17/06; F41A 17/02; F41A 17/04; F41A 17/00; F41A 17/066
USPC ..... 42/70.11
See application file for complete search history.

(56) References Cited

U.S. PATENT DOCUMENTS

| | | | | | |
|---|---|---|---|---|---|
| 4,467,545 | A * | 8/1984 | Shaw, Jr. | F41A 17/066 | 42/70.01 |
| 5,192,818 | A * | 3/1993 | Martin | F41A 17/06 | 42/70.01 |
| 5,664,358 | A * | 9/1997 | Haber | F41A 17/44 | 42/44 |
| 5,699,687 | A * | 12/1997 | Pittman | F41A 17/02 | 42/70.11 |
| 5,860,241 | A * | 1/1999 | Waters | F41A 17/06 | 42/66 |
| 6,260,300 | B1 * | 7/2001 | Klebes | F41A 17/066 | 206/317 |
| 6,526,684 | B1 * | 3/2003 | Hickerson | F41A 17/44 | 42/70.01 |
| 6,560,910 | B1 * | 5/2003 | McLaren | F41A 17/04 | 42/70.11 |
| 6,634,130 | B1 * | 10/2003 | Balchunas | F41A 17/44 | 42/70.11 |
| 6,701,655 | B2 * | 3/2004 | Milo | F41A 17/44 | 42/70.11 |
| 6,845,640 | B2 * | 1/2005 | Loeff | E05B 53/003 | 109/45 |
| 7,584,566 | B2 * | 9/2009 | Victor | F41A 17/02 | 42/70.06 |
| 7,921,588 | B2 * | 4/2011 | Brown | F41H 13/0068 | 42/70.01 |
| 9,651,325 | B1 * | 5/2017 | Gant | F41A 17/06 | |
| 2013/0318847 | A1 * | 12/2013 | Kelly | F41A 17/46 | 42/70.06 |

(Continued)

*Primary Examiner* — Joshua E Freeman
(74) *Attorney, Agent, or Firm* — Ryan Kromholz & Manion, S.C.

(57) ABSTRACT

An apparatus and method for an RFID operated gun lock is disclosed. The gun lock comprises a security assembly secured to the muzzle of a firearm and RFID communication for locking and unlocking the firearm. A safety round is also employed and a power sub-system is provided to operate the apparatus. A manual override feature is also disclosed.

4 Claims, 16 Drawing Sheets

(56) References Cited

U.S. PATENT DOCUMENTS

| | | | | |
|---|---|---|---|---|
| 2016/0054083 | A1* | 2/2016 | Kiyani | F41A 17/06 42/70.11 |
| 2020/0072570 | A1* | 3/2020 | Sun | F41A 17/06 |

* cited by examiner

RFID GUN LOCK

RELATED APPLICATIONS

This application claims the benefit of Provisional Application Ser. No. 62/794,156 filed 18 Jan. 2019 and Provisional Application Ser. No. 62/813,405, filed 4 Mar. 2019.

BACKGROUND OF THE INVENTION

The present invention comprises an apparatus for safely locking and unlocking firearms and a method of using the apparatus. More specifically, the present invention comprises an apparatus for safely locking and readily unlocking firearms using radio frequency identification (RFID) technology and a method of locking and unlocking a firearm using the RFID apparatus.

According to recent national studies, approximately 42% of U.S. households owned a firearm in 2017. Accordingly, it is estimated that 22 million children in the U.S. live in homes with at least one firearm, and approximately 4.6 million children live in households with at least one loaded and unlocked firearm.

Along with firearm ownership comes the risk of unauthorized or accidental use. Managing the balance between having a loaded firearm accessible for protection, and securing firearms from unintended use and discharge, has previously been challenging. Prior art solutions to securing firearms have included keyed and dial locking mechanisms to secure either the trigger or barrel of the firearm.

However, these prior art solutions require a coordinated effort to unlock. In a situation requiring use of a firearm, an owner's fine motor skills are typically reduced such that unlocking prior art systems is difficult precisely when the firearm is required.

A need therefore exists for an improved locking system which provides the user with the ability to unlock the firearm without procedures such as inserting a small key into a correspondingly small key lock, or recalling and precisely input a numeric code or the like.

In addition, as with all automated systems, contingencies need to be in place for manual override. A need therefore exists for an improved locking system that further provides for a manual override so that electronic unlocking features can be bypassed.

SUMMARY OF THE INVENTION

The present invention comprises a gun lock to be used in connection with a firearm. Radio frequency identification (RFID) technology permits digital data encoded in RFID tags to be captured by an RFID reader via radio waves.

The security assembly of the present invention preferably comprises at least a housing containing a power sub-system, a stem sleeve and stem, a safety round within a chamber sub-system, an RFID reader, and a manual override unit. When the security assembly is secured to the muzzle of the firearm, the firearm is unable to be operated. When the security assembly is removed from communication with the firearm, the firearm is operable.

In a locked configuration, the stem is securely contained in a stem sleeve that extends from the muzzle through the barrel cavity to a chamber sub-system. When unlocked, the stem extends from the chamber to the muzzle opening and through the security housing and further extends beyond the housing to indicate unlocked status.

An RFID reader is positioned on or in the security housing such that proximity of an RFID transmitter, embodied in a key, tag, card, fob, or other article, activates locking and unlocking of the gun lock. The mechanics of the locking/unlocking process are completed by a control unit and an actuating unit.

The control sub-system preferably comprises a battery, radio wave antennae, a sensor, and a control circuit. The control sub-system is in electrical communication with the actuating sub-system.

The actuating sub-system preferably comprises a motor, gearbox, drive shaft, arm actuating offset cam assembly, and release arm. Other mechanisms for operating the RFID lock/unlock apparatus are also suitable.

The manual override unit comprises a manual override button, an override wedge, and a d-al lock mechanism in communication with the actuating unit for manually locking and unlocking the gun lock.

The stem end facing the firearm handle is inserted into a safety round positioned in the chamber. A graduated detent cut from and extending axially along the stem end contains a ball bearing. The ball bearing is thus slidable axially along the detent. In a locked configuration, the ball bearing extends partially out of the detent into an annular groove cut from within the interior safety round. In an unlocked configuration, the ball bearing is urged out of connection with the annular groove.

A currently preferred method of operating the apparatus is likewise described. The method of operation provides the benefit of the user being able to unlock a locking system without needing to precisely input information, providing an RFID system to unlock the locking system, and providing a manual override feature for bypassing electronic unlocking features.

Additional benefits of the present invention include size and tamper-resistance. The lock is compact and portable for safety in all manners of storage locations.

DESCRIPTION OF THE PREFERRED EMBODIMENT—APPARATUS

Figure 1:
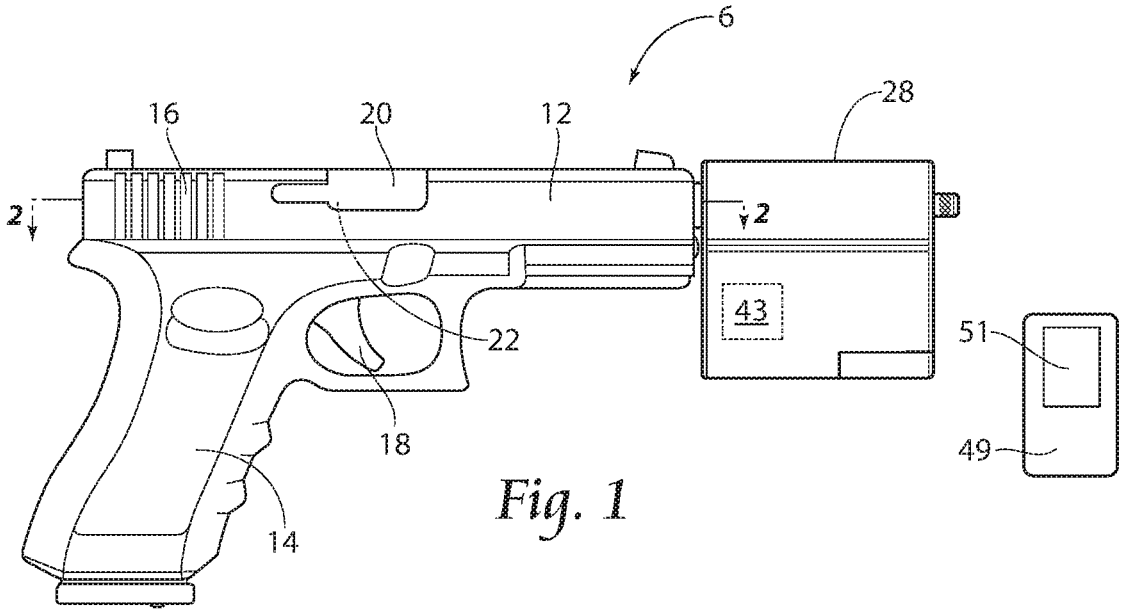
FIG. 1 is a side view of a first embodiment of an invention for a gun lock in connection with a firearm.
Figure 21A:
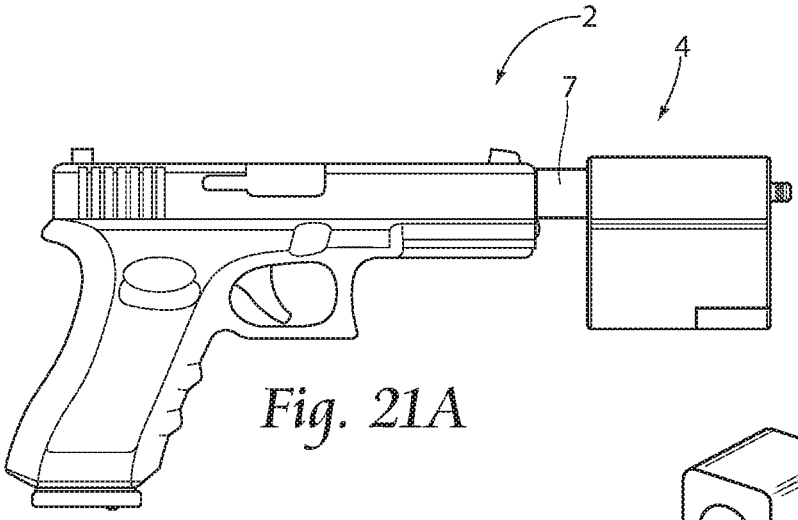
FIG. 21A is a side view of a firearm in connection with a security housing of an embodiment of the present invention having an adapter interposed therebetween.
Figure 21B:
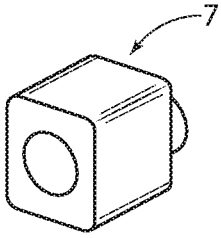
FIG. 21B is a perspective view of the adapter shown in FIG. 21A.
Figure 22A:
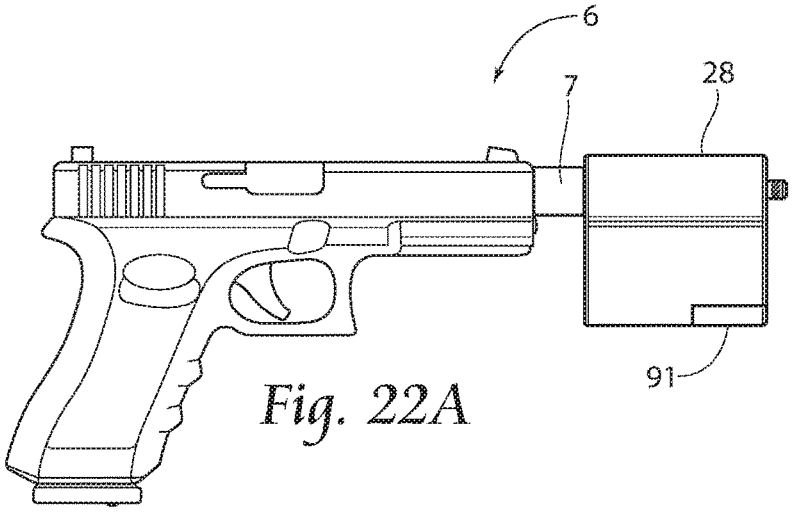
FIGS. 22A and 22B show a different embodiment of the adapter shown in FIGS. 21A and B.
Figure 22B:
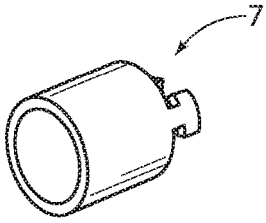
Figure 23A:
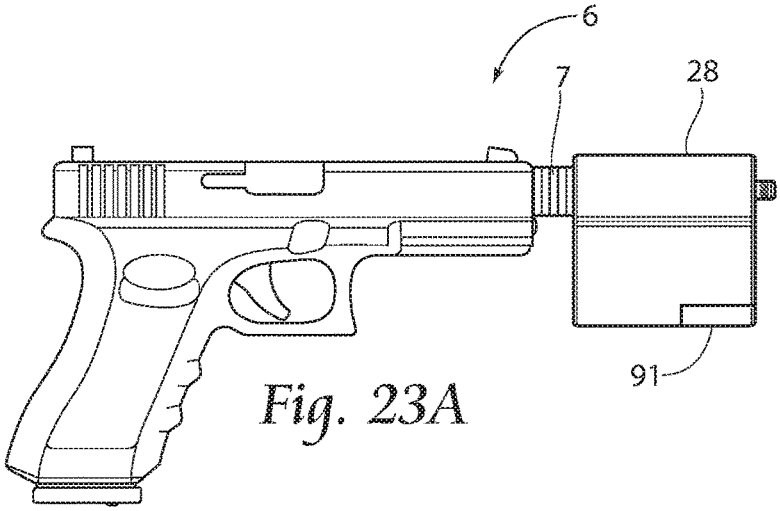
FIGS. 23A and 23B are similar to FIGS. 21A/B and 22A/B showing yet another embodiment of an adapter.
Figure 23B:
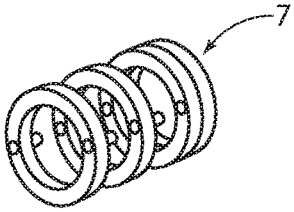

Referring to FIG. 1, a firearm 6 is shown fitted with a security assembly 4. As is generally known, firearm 6 has a muzzle 8, barrel 10, chamber 22, handle 14, and trigger 18. Firearm 6 may include an ejection port 20 in close proximity to chamber 10. If the barrel 10 of the firearm 6 to be locked is not as long as the stem 32 of the present invention, an adapter 7 such as shown in FIGS. 21-23 may be used between muzzle 8 and security housing 28.

In connection with the discussion of an adapter 7, it should be noted that the present invention is designed for modularity. The invention can be designed for and/or adapted to fit multiple caliper sizes (9 mm, .40 and .45 ACP) as well as variable barrel lengths.

The invention is directed to a security assembly 4 for attachment to a firearm 6 that permits locking and unlocking of the firearm 6. A security housing 28 contains an RFID reader 43 and a control sub-system 57. A stem sleeve 108 extends through the barrel 10 from the distal end of muzzle 8 through to the chamber 22. A stem 32 fits within the stem sleeve 108 and is removably connected to a safety round 40 located within the chamber 22. The security housing 28 may have a surface texture (in this case exterior surface 45) to promote gripping.

Figure 2:
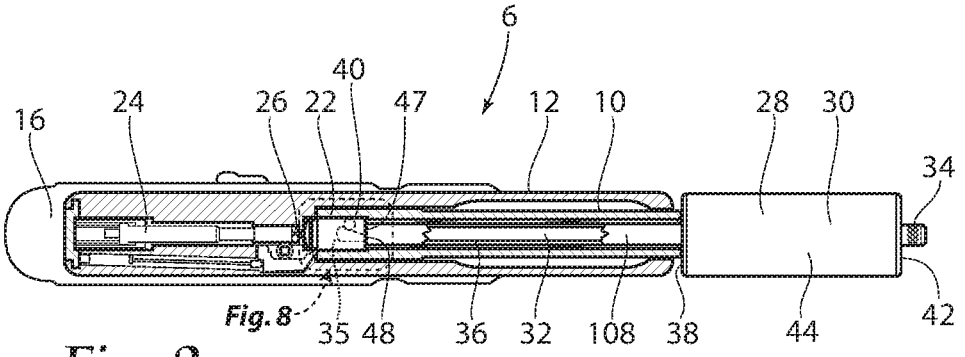
FIG. 2 is a top cross-sectional view of the first embodiment taken from line 2-2 of FIG. 1.

As illustrated in FIG. 2, when the security assembly 4 is in locked communication with the firearm 6, the security housing 28 (second side 38) is in communication with the muzzle 8 at the muzzle opening 11. Also shown in FIG. 2 are barrel 10, barrel assembly 12, gun rear 16, chamber 22, firing assembly 24, chamber second end 26, stem 32, stem first end 34, stem second end 35, stem shaft 36, safety round 40, security housing first side 42, security housing sleeve 44, barrel second end 47, barrel cavity 48, and stem sleeve 108.

Figure 3A:
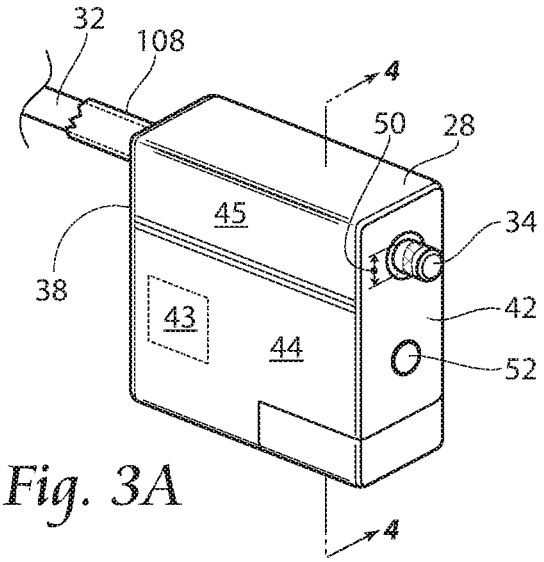
FIG. 3A is a front perspective view of a security housing of the first embodiment, illustrating a security housing and a partial view of the stem/stem sleeve.

FIG. 3A is a front perspective view of a security housing 28 of the security assembly 4 showing a gun lock indicator (stem first end 34) and a manual override button 52. A broken line box 43 indicates the general location of the RFID reader 43 on or within the housing 28. Note that while the present application discusses the security housing 28 as located at the distal end (muzzle 8) of firearm 6, it is fully within the scope of the invention to have the security housing, or subparts thereof, located in other places such as on top of the firearm 6 or on its side.

Figure 3B:
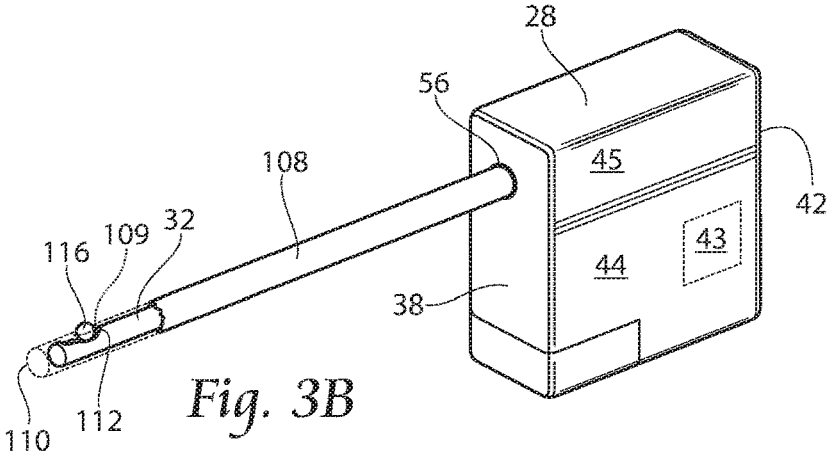
FIG. 3B is a rear perspective view of the security housing of the first embodiment, now illustrating the stem extending from the rear of security housing.

FIG. 3B is a rear perspective view of the security housing 28 of the gun lock 4. Security housing second side 38 provides for a second side opening 56 through which stem 32 travels during the locking and unlocking process. A stem sleeve 108 is attached to security housing 28 second side 38 about the second side opening and contains a stem 32. The stem 32 is shown extending from the stem sleeve 108 such that a portion of the chamber sub-system, including stem second end 35, cavity 112, and ball bearing 116 are shown.

Figure 3C:
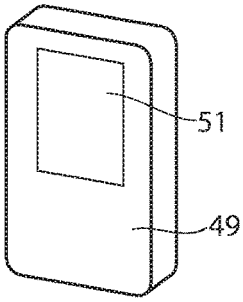
FIG. 3C is a perspective view of an embodiment of an RFID transmitter of the invention.

FIG. 3C is a perspective view of the RFID transmitter body 51 containing transmitter 49 of the invention. The transmitter 49 can be in the shape of an access card, key fob, bracelet, or any other appropriate RFID wave transmitting device. The format of the transmitter 49 could be chosen by the owner, and could be customized in a variety of ways. Note that if the user cannot access the transmitter 49 for any reason, a mechanical override unit 55 (discussed in further detail infra) is provided.

Figure 8:
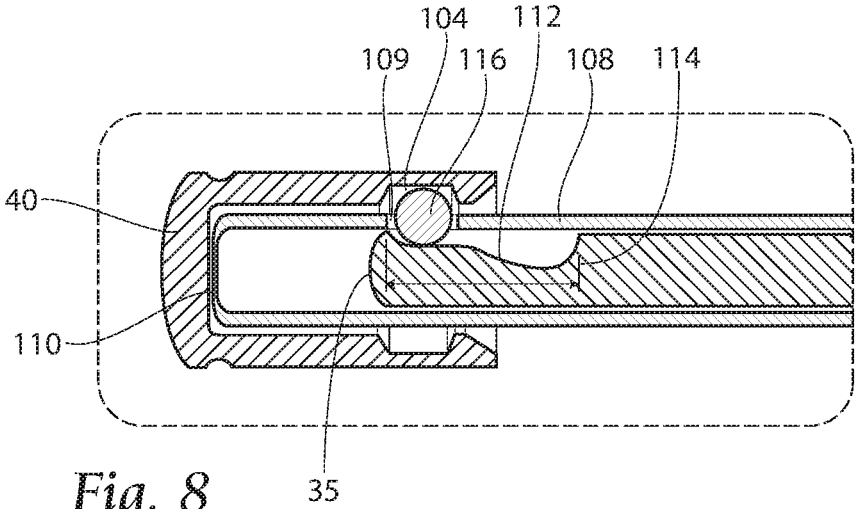
FIG. 8 is cross-sectional view of a stem in connection with a safety round of the first embodiment of the invention.

FIG. 8 is a close-up view of the broken line oval shown in FIG. 2, illustrating a chamber sub-system. When the transmitter 49 is placed in proximal communication with the reader 43, the chamber sub-system, generally comprising safety round 40, annular ring 104, stem plate 33, stem end 35, aperture 109, ball bearing 116, and cavity 112, stem 32 is released from within the barrel 10. The entire security assembly 4 is then removed from muzzle 8 and appears substantially as shown in FIG. 3B.

Figure 4:
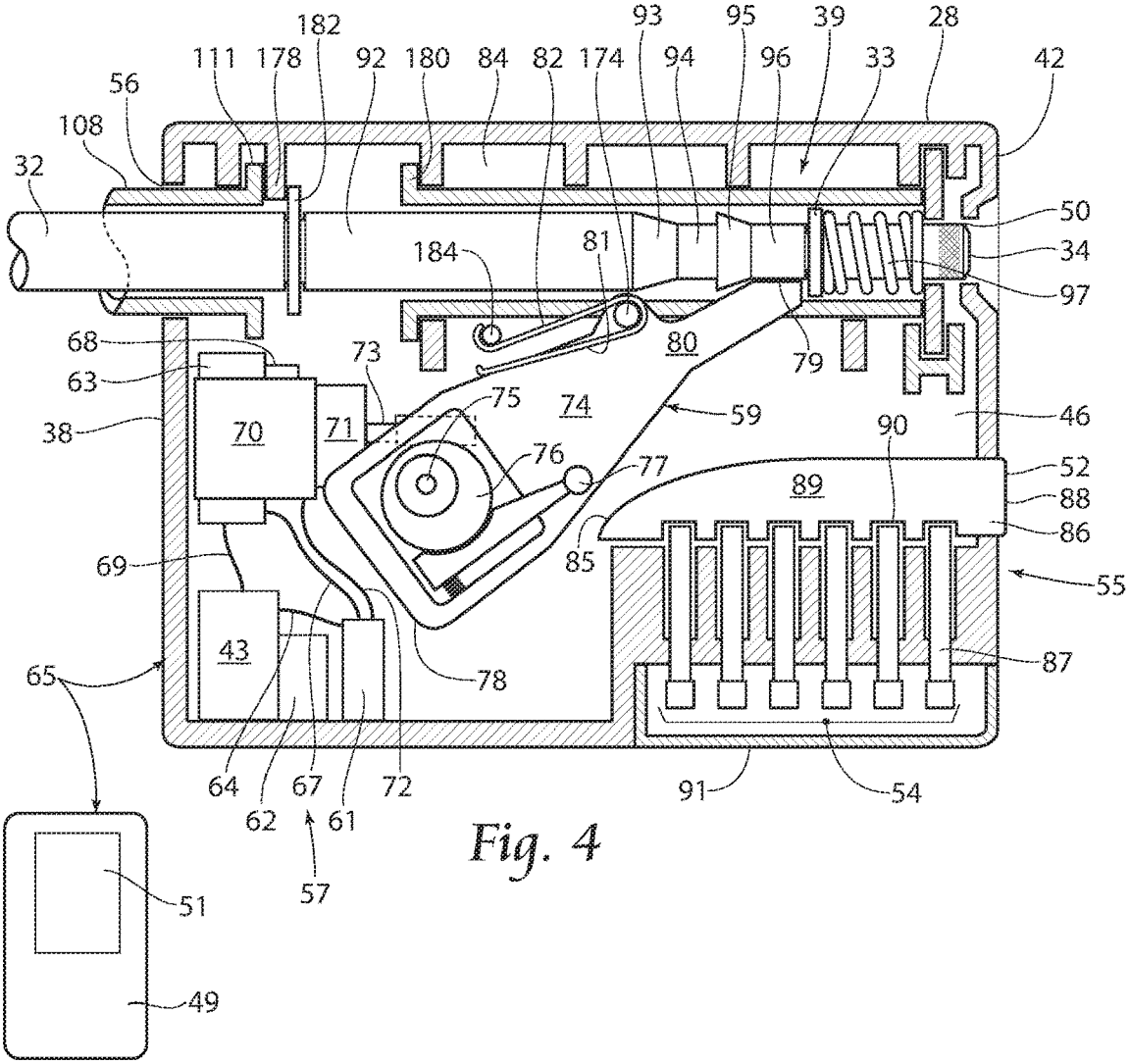
FIG. 4 is a cross-sectional view of the security housing of a first embodiment of the invention.

Turning now to FIG. 4, the security assembly 4 further includes a power sub-system generally comprising a control unit 57, an actuating sub-system 59, a battery 61, an RFID reader antenna 62, a control circuit 63, and a plurality of connections therebetween. In one embodiment for example, the battery 61 is connected to the RFID reader 43 by connection 64, the battery 61 is connected to the control circuit 63 by connection 67, and the battery 61 is connected to a motor 70 by connection 72. The RFID reader 43 is also connected to the control unit 63 by way of connection 69.

In a currently preferred mode, the battery 61 has a life of 1+ years utilizing off-the-shelf batteries. Obviously, regular maintenance of the lock 4 includes battery testing and, when needed, battery replacement. As previously mentioned, a mechanical override unit 55 (discussed in further detail infra) is provided in case the battery were to die unexpectedly.

Figure 5:
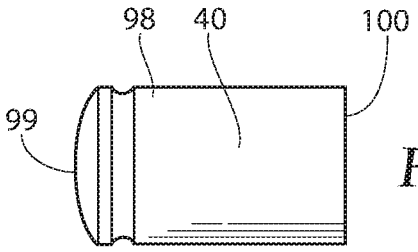
FIG. 5 is a side view of the safety round of a first embodiment of the invention.
Figure 6:
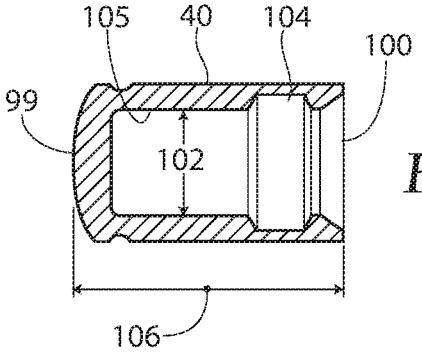
FIG. 6 is a cross-sectional view of FIG. 5.
Figure 7:
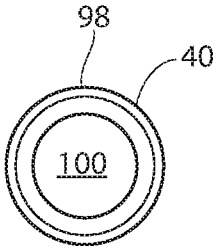
FIG. 7 is a rear end view of FIG. 5.

FIGS. 5-7 are directed to the exterior and interior features of safety round 40. These include body 98, end 99, opening 100, retention feature 104, inner wall 105, stem sleeve 108, stem sleeve aperture 109, stem sleeve proximal end 110, cavity 112, and ball bearing 116. The safety round 40 has an internal diameter 102, a safety round length 106, and a cavity length 114 all commensurate with the size of the firearm 6 and other variables.

Figure 9A:
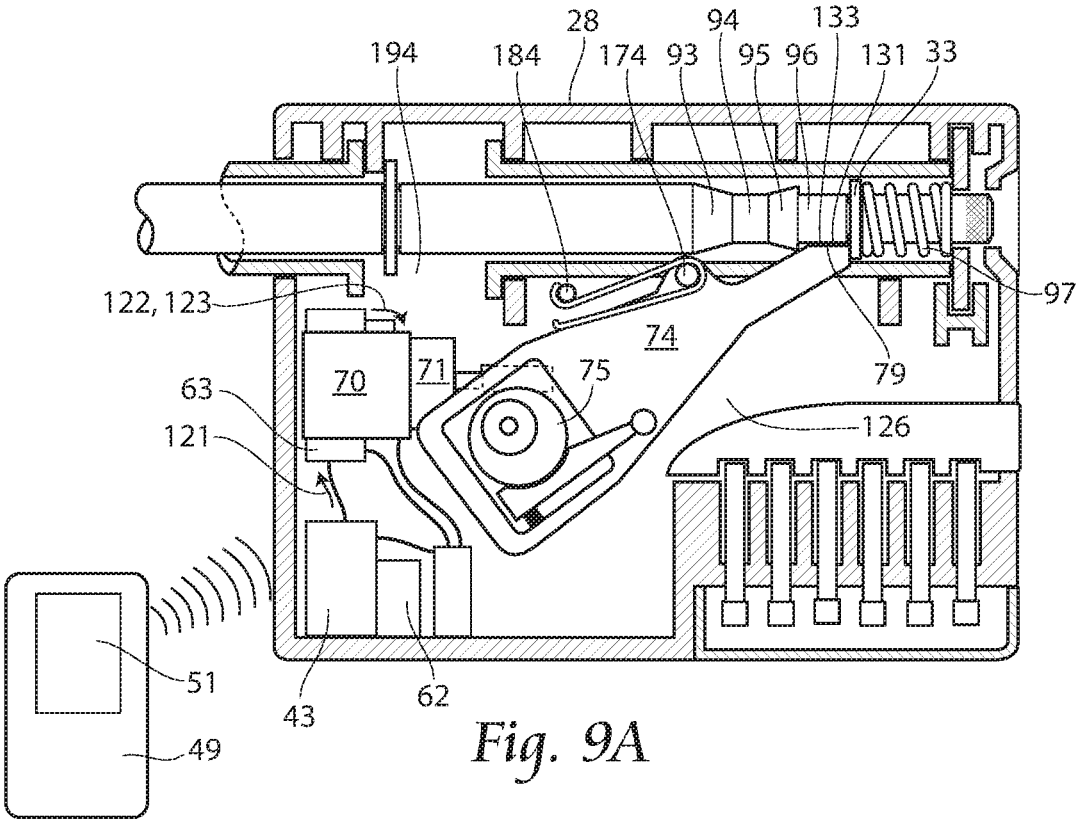
FIG. 9A is a cross-sectional view of the security housing of a first embodiment of the invention being locked.
Figure 9B:
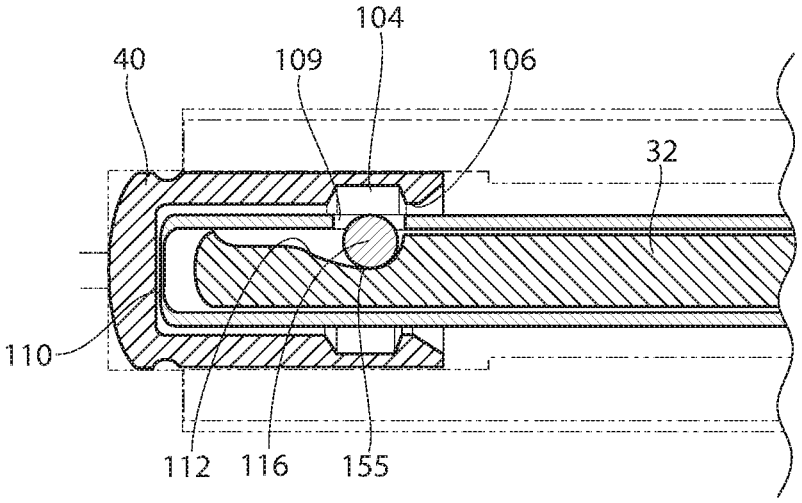
FIG. 9B is a cross-sectional view of the security housing of a first embodiment of the invention being locked.
Figure 10A:
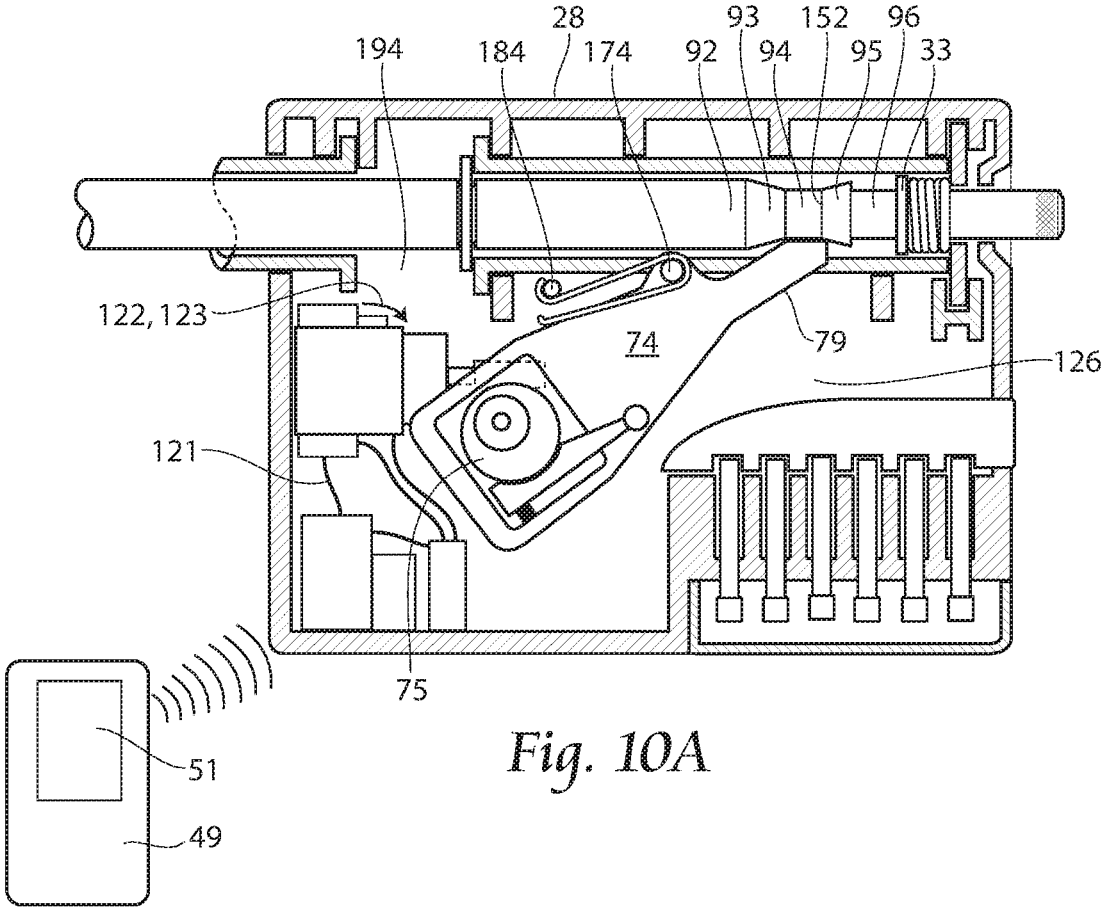
FIG. 10A is a cross-sectional view of the security housing of a first embodiment of the invention being unlocked.
Figure 10B:
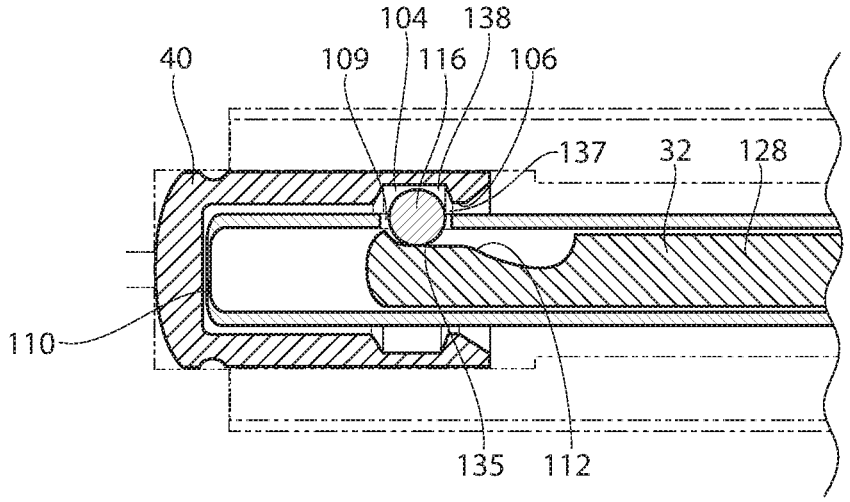
FIG. 10B is a cross-sectional view of the security housing of a first embodiment of the invention being unlocked.
Figure 11A:
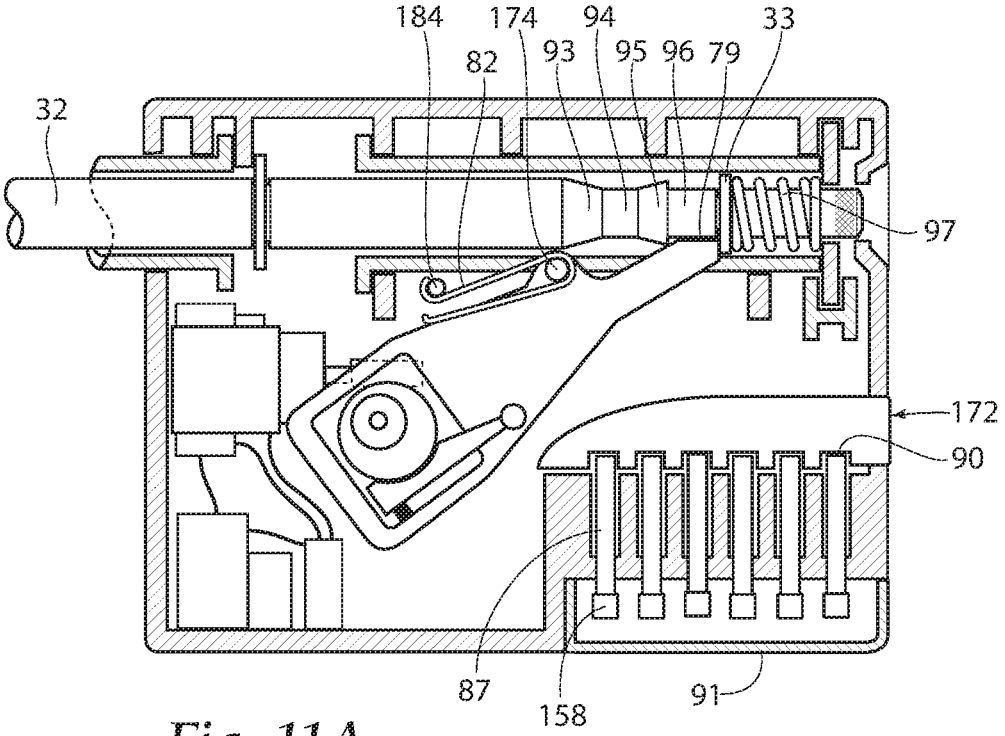
FIGS. 11A and 11B are cross-sectional views of the security housing of a first embodiment of the invention illustrating a manual override locking operation.
Figure 11B:
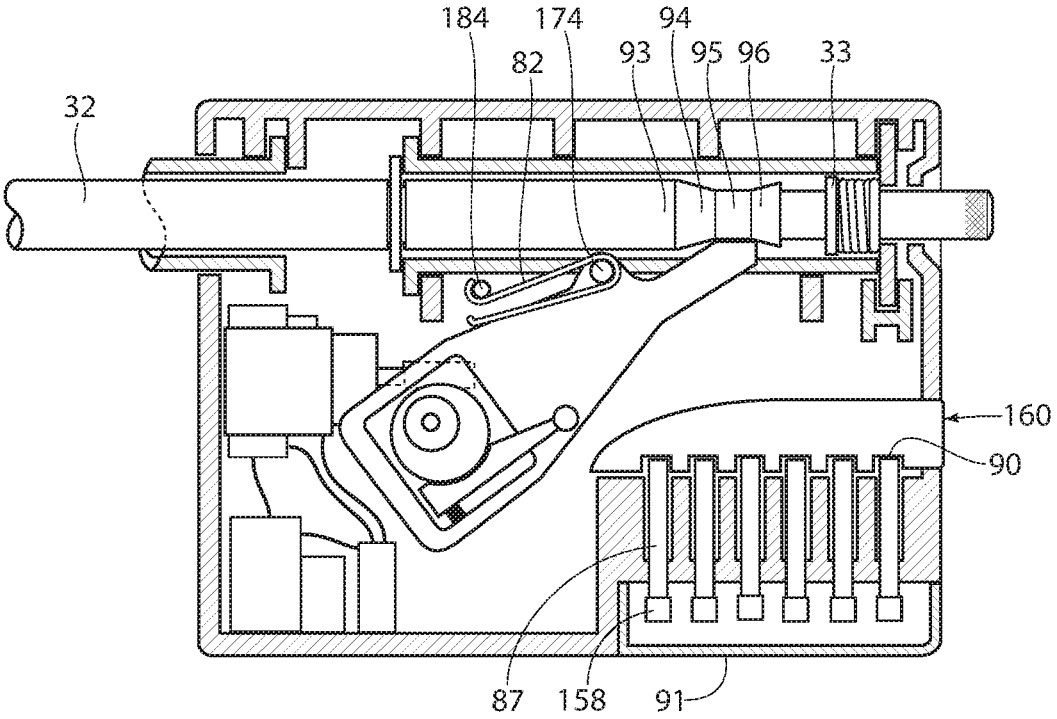

FIGS. 9A and 9B can be viewed in tandem with FIGS. 10A and 10B as they illustrate the same embodiment utilizing the same part numerals, only moving in opposite directions, i.e. into a locked position and into an unlocked position respectively. With reference in part to the elements enumerated in FIG. 4, it can be seen that the mechanics of the locking/unlocking action take place by way of an offset cam assembly 75. The assembly 75 generally includes a release arm 74, offset cam 76, arm release 77, arm first end 78, actuating arm second end 79, actuating arm body 80, and an actuating arm spring 82. Spring 82 is carried on the an arm body 174 extending from the arm 74 and an interior body 184 extending from interior surface 84 of security housing 28.

As an alternative to the active RFID system described above, a passive RFID system could also be employed. Passive RFID systems have the advantage of not requiring a battery and the concomitant need to replace the battery. However, while active RFID systems are battery operated, they have the advantage of longer wavelengths and the ability to function well with different materials —notably including metals—and harsher environmental conditions in general.

Battery 61 further supplies power to control circuit 63 through a control circuit/battery communication 67. At least one of RFID reader 43 and RFID reader antenna 62 is in electrical communication with control circuit 63 through the control circuit/RFID communication 69. The RFID reader 43 and/or the RFID reader antenna 62 detects the RFID transmitter 49 and sends an electrical signal to the control circuit 63.

When the gun lock 4 is in a locked position, the signal is processed by the control circuit 63 to retract the gun lock 4 to the unlocked position. Likewise, when gun lock 4 is in an unlocked position, the signal is processed by control circuit 63 to actuate sub-system 59 to advance gun lock 4 to the opposite position, i.e. the locked position.

Control circuit 63 is in electrical communication with actuating sub-system 59 through motor/control circuit communication 68. Specifically, control circuit 63 is in electrical communication with motor 10 through motor/control circuit communication 68. Actuating sub-system 59 comprises motor 70, gearbox 71, drive shaft 73, arm actuating assembly 75, and release arm 74. Motor 70 is in communication with the gear box 71.

Motor 70 is in electrical communication with battery 61 through a motor/battery communication 72 such that battery 61 supplies energy to motor 70. Motor 70 then provides motion which is transferred to gearbox 71. Gearbox 71 is in communication with drive shaft 73, now transferring rotation to arm actuating assembly 15. Arm actuating assembly 75 is in rotational communication with release arm 74, such that rotation of arm actuating assembly 75 rotates release arm 74. Specifically, offset cam 76 of arm actuating assembly 75 is in rotational communication with release arm 74, wherein rotation of offset cam 76 rotates release arm 74 thus initiating the release segment of the method of the present invention.

The motor 70 could be replaced by a solenoid or residual magnet. Each has advantages and disadvantages and the currently preferred mode is described herein with respect to a motor. In addition, other drive system options include a worm drive, power screw/wedge drive, and a trigger mechanism with cam and motor drive release.

As seen in FIG. 4, release arm 74 comprises a release arm first end 78 and a release arm second end 79 separated by a release arm body 80. Positioned in close proximity to release arm first end 78 is arm actuating assembly 75. Release arm second end 79 provides for contact with a portion of stem 32. A release arm spring 82 is provided along release arm body 80, providing a bias against the direction of rotation of release arm 74 resulting from the rotation of arm actuating assembly 75. The release arm spring 82 is in held in communication with an interior surface 84 of the security housing 28 by way of an interior surface body 184, such as a peg or shaft, and with the release arm 74 by way of an arm surface body 174, such as a peg or shaft. Alternately, release arm 74 can be in the form of a disc having an extension (not shown).

Figure 24:
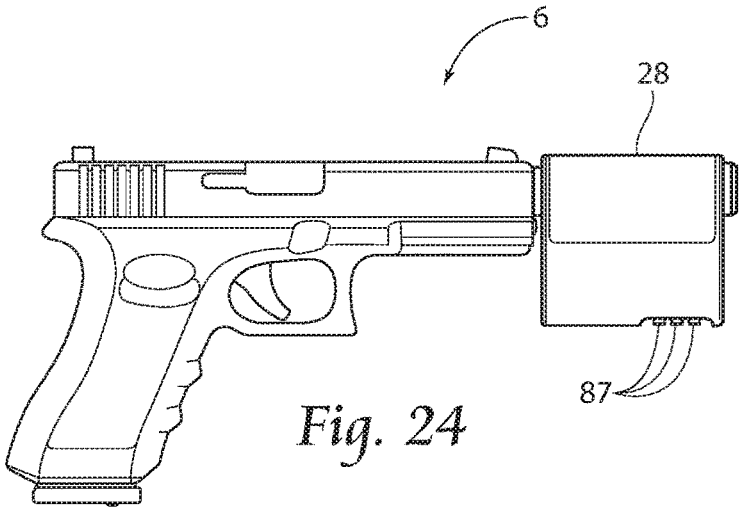
FIG. 24 shows another embodiment of an override mechanism of the invention.

Still referring to FIG. 4, a manual override unit 55 comprises at least one of a manual override button 52, an override body 89, and a dial lock mechanism 54. Manual override button 52 is formed by the distal end 88 of body 89. The override body 89 is shown in the shape of a wedge having a sloped proximal end 85. The dial lock 54 of the manual override unit 55 can be covered with an override access door 91 or, as seen in FIG. 24, can be left exposed.

The dial lock mechanism 54 comprises at least one dial 87, but preferably has six dials 87. Override body 89 bears recesses 90 for each of dials 87. The function of dial locks is well known. Other override locks besides combination dials are well known in the art and are considered well within the bounds of the invention.

FIG. 4 also illustrates the stem 32 extending from the chamber sub-system through a first side opening 56 into the security housing cavity 46 and through the first side opening 50. Within the housing cavity 46, the stem 32 has a first, primary diameter 92, a first frustoconical portion 93, a second diameter 94, a second frustoconical portion 95, and a third diameter 96.

FIGS. 5-7 show the safety round 40 and chamber sub-system. The body 98 of safety round 40 is designed to replicate the size and shape of a shell casing of a round of ammunition. As such, the safety round 40 may be of various sizes to accommodate the caliber of ammunition intended to be fired by firearm 6.

The safety round 40 has a closed end 99 and an open end 100. The body 98 defines an inner wall 105, and its diameter 102 is sized to accommodate the stem 32, as seen in FIG. 8. A groove or notch 104 is cut into the wall 105, with notch 104 having a diameter larger than diameter 102 so that turning the stem 32 turns the bearing 116 to a location entirely within the stem sleeve 108 for easy removal. Note that the notch 104 could also be a groove or pair of notches or other retention arrangement.

FIG. 8 details the locking element of the chamber sub-system. As can be seen, stem sleeve 108 extends into the safety round 40, and the sleeve 108 contains the stem 32. The free end 35 of the stem 32 has a sloped surface 112 cut into its circumference, giving rise to a cavity extending along the stem 32 adjacent the second end 35.

The sloped surface 112 has a first, hook end 113*a* and a second, stop end 113*b*. The surface itself has a high end and a low end, with the high end being closer to the stem end 35.

A moving part such as a ball bearing 116 is located within the cavity and is slidable between the high end and low end of the surface 112. As such, when the stem 32 is moved, the surface and relative locations of the high and low end also move.

FIG. 9A shows the release arm second end 79 in communication with the third diameter 96, and FIG. 10A shows the release arm second end 79 in communication with the second diameter 94. It can be seen that release arm 77 and related arm spring 82 act to seat end 79 against one of the second or third diameters 94, 96.

When the arm 74 is actuated from the locked position seen in FIG. 10A to the unlocked position seen in FIG. 9A, the end 79 is permitted to slide over frustoconical portion 95 to be seated at the third diameter 96 but not beyond, being held in place at least by plate 33.

A compression spring 97 is positioned between the third diameter 96 and the stem first end 34 having a bias towards the unlocked position of the gun lock 4. A stem sleeve second end extends through the second side opening 56 and is in fixed communication with the interior surface 84. Alternatively, a stem sleeve second end may extend through the second side opening 56 and is removably attached to the interior surface 84.

When in the unlocked position, the locking ball 116 does not engage the safety round 40. As seen in FIG. 10B, the bearing 116 is positioned on the high end such that it is urged into a secured position in connection with a void such as the notch 104.

When in the locked position, the stem 32 forces the ball 116 into the safety round 40, locking the two components together. As seen in FIG. 9B, in a locked configuration, as the bearing 116 is at the high end of the cavity 112, it is urged into at least partially in to an aperture 109.

Figure 12A:
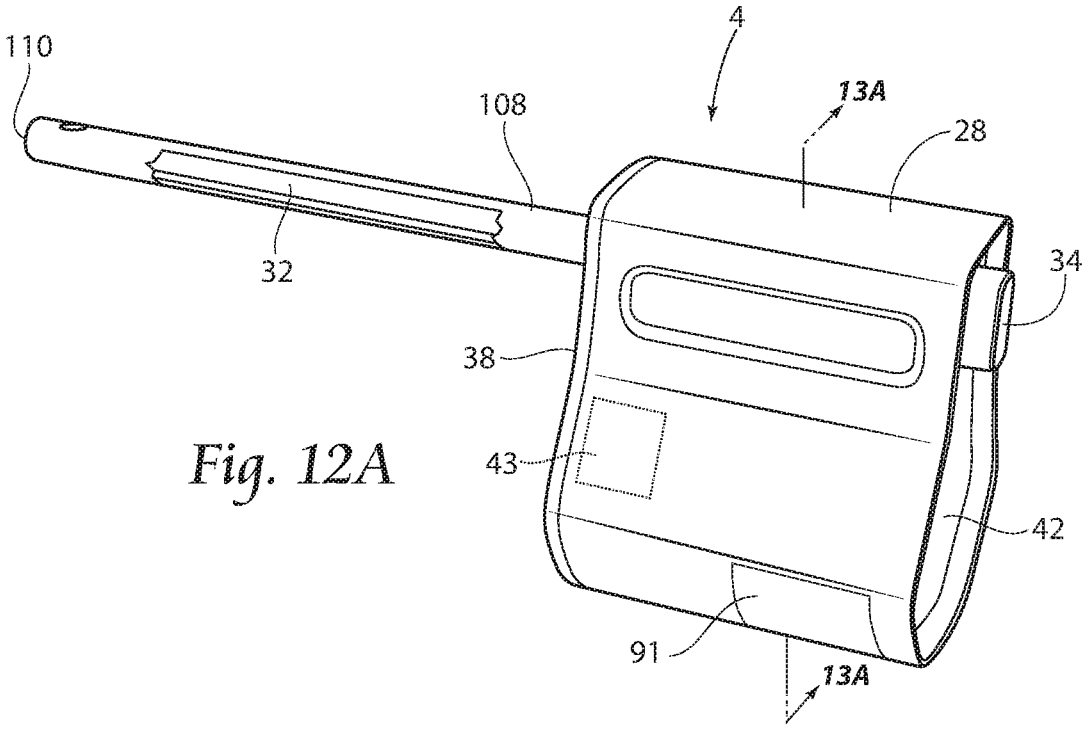
FIG. 12A is a perspective view of a second embodiment of the security housing, illustrating a stem extending from a security housing second side.
Figure 12B:
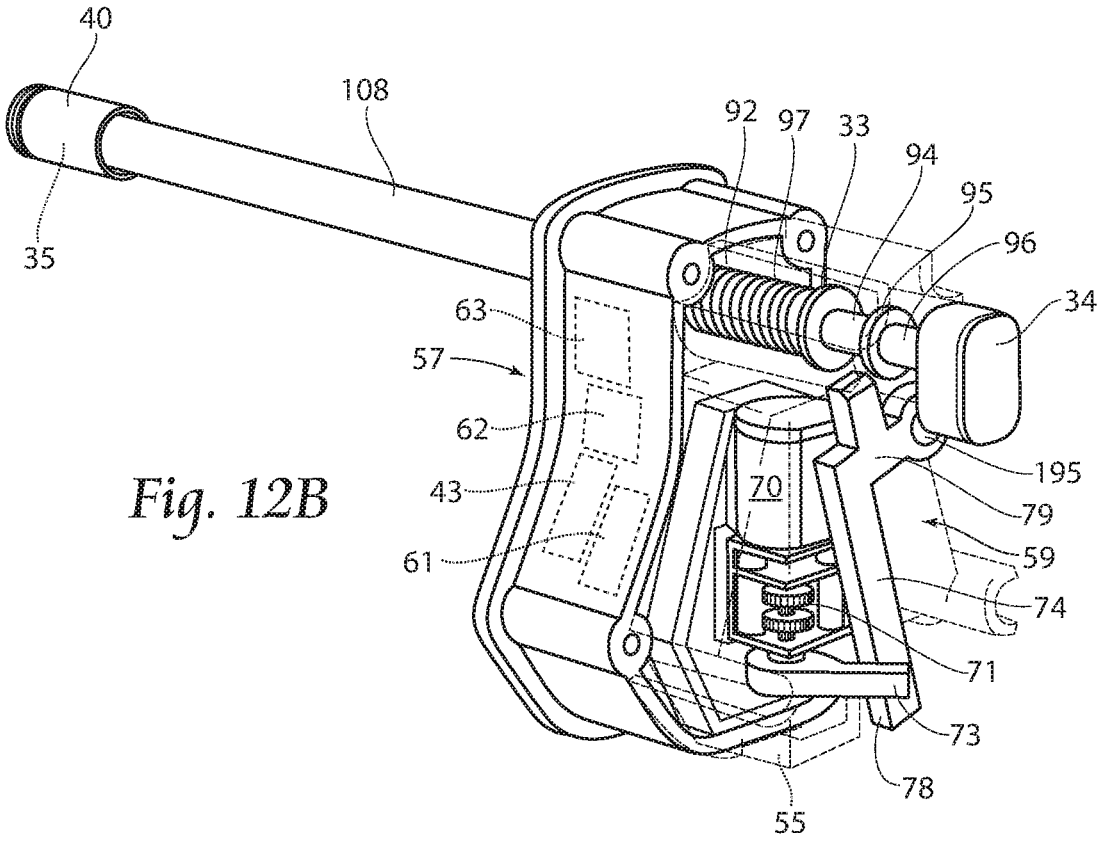
FIG. 12B is an exploded perspective view of FIG. 12A showing the interior of the security housing.

Moving now to FIGS. 12A and 12B, another embodiment of the security housing is shown. In this embodiment, the security housing 28 is differently shaped. It is believed that there are ergonomic advantages to this shape, but more importantly, it is shaped to accommodate a lock 4 that works in a non-axial direction.

In this embodiment, the action of release arm 74 now operates to seat against the circumference of the stem 32 rather than against its axial surface. Just as with the previous embodiment, and as generally seen in FIGS. 13-14, the control sub-system (indicated schematically as before) operates the mechanical sub-system, including the motor 70, the release arm 77, the stem 32 and stem second and third diameters 94, 96 with a frustoconical portion 95 therebetween.

A plate 33 is attached to the stem 32 in a similar fashion as before, but the spring 97 is now found at the proximal end of the stem 32. In a locked position, the spring 97 is compressed against the plate 33 and the arm end 79 is seated at the stem third diameter 96 as seen in FIG. 13B.

Figure 13A:
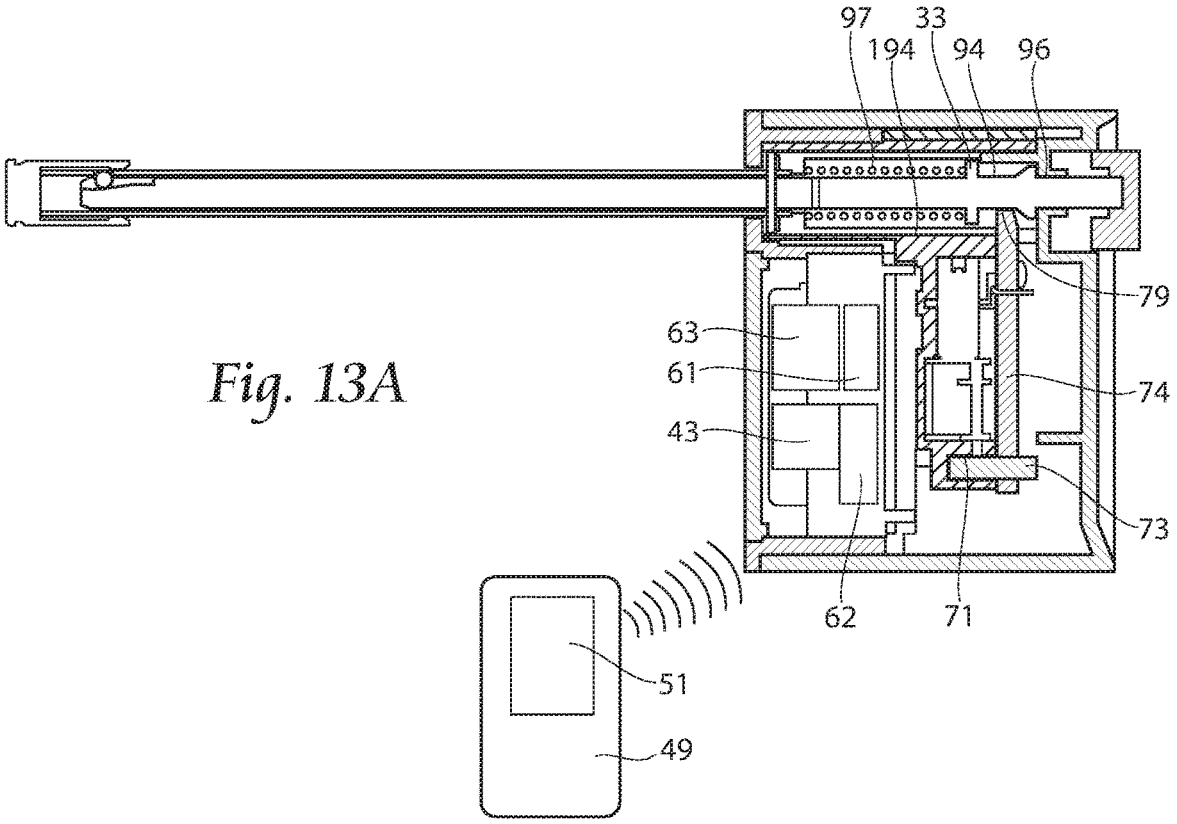
FIG. 13A shows a second embodiment of invention illustrating the locking operation of a gun lock.
Figure 13B:
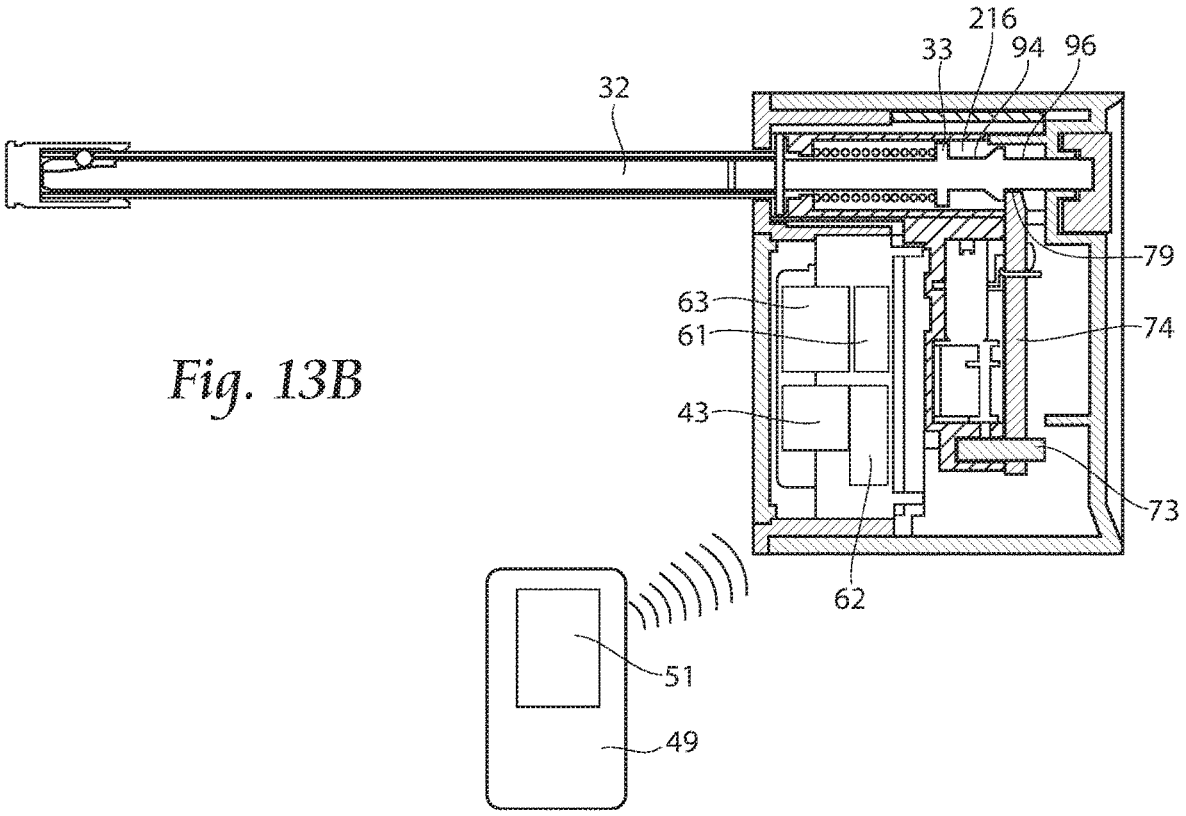
FIG. 13B shows a second embodiment of invention illustrating the unlocking operation of a gun lock.

In the unlocked position shown in FIG. 13A, after arm 74 has been activated to move away from stem 32 in order to overcome the portion 95, the spring 97 is permitted to expand to partially eject the stem 32. The action of the chamber sub-system is the same as that of the first embodiment, also serving to release the stem 32 from the stem sleeve 108 and the safety round 40. Arm 74 returns to its biased-against-the-stem orientation and seats at second diameter 94.

Figure 14A:
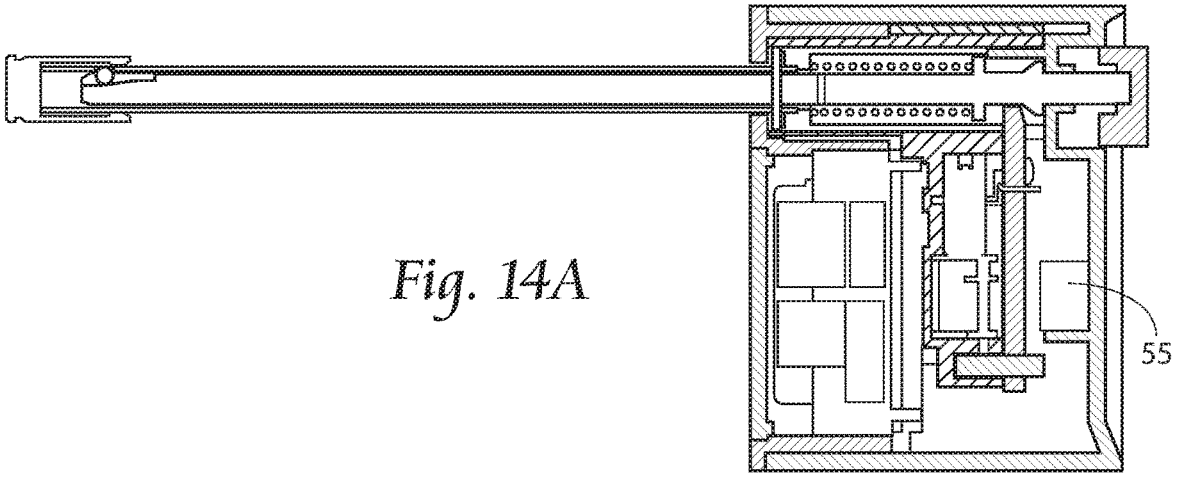
FIGS. 14A and 14B show side cross-sectional views of a second embodiment of the invention in locked and unlocked positions respectively.
Figure 14B:
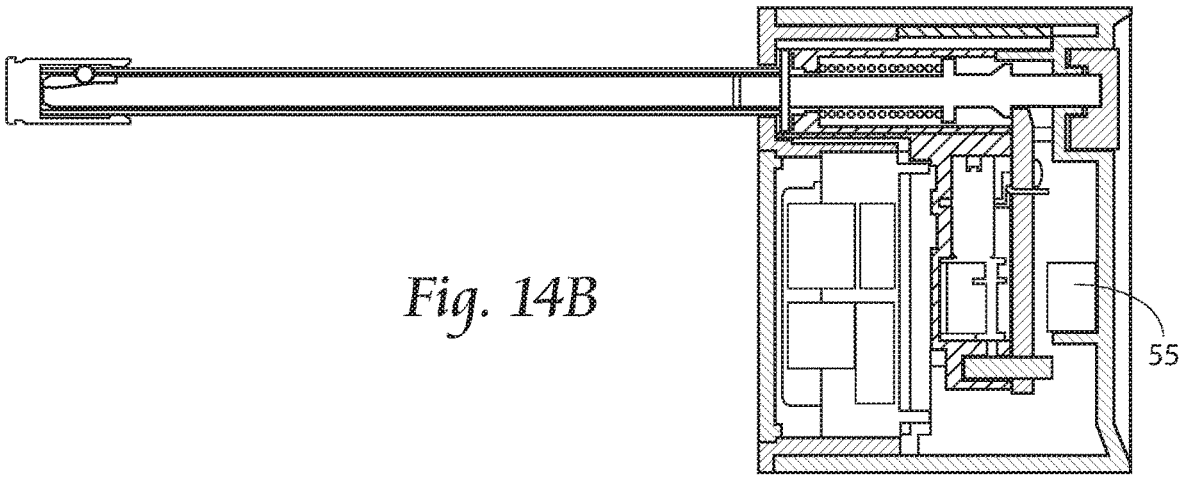

Note that a manual override is also present in this embodiment, as suggested by the presence of one possible location of an override access door 91 in FIG. 12A. FIGS. 14A and 14B are identical to FIGS. 13A and 13B except that now a schematic representation of the override unit 55 is shown.

Different embodiments of the chamber sub-system are also contemplated as shown in FIGS. 15A-18D. For example, FIGS. 15C and 15D show a side view of the safety round 40 in which the portion of stem sleeve 108 that resides within diameter 102 is separable by pressure from the portion of sleeve 108 that extends out from opening 100. This portion is found at reference numeral 107 and, in the locked position, is wedged apart and its ends seat within cavity 102 at lip 101 to prevent removal of the stem 32.

Figure 15A:
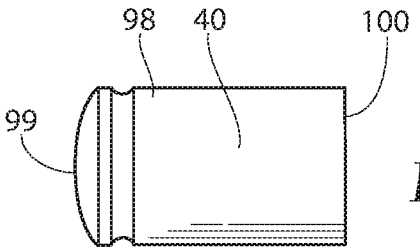
FIG. 15A shows a side view of the safety round of a second embodiment.
Figure 15B:
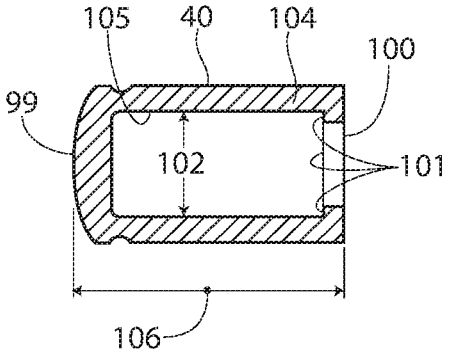
FIG. 15B shows a cross-sectional view of the safety round of a second embodiment.
Figure 15C:
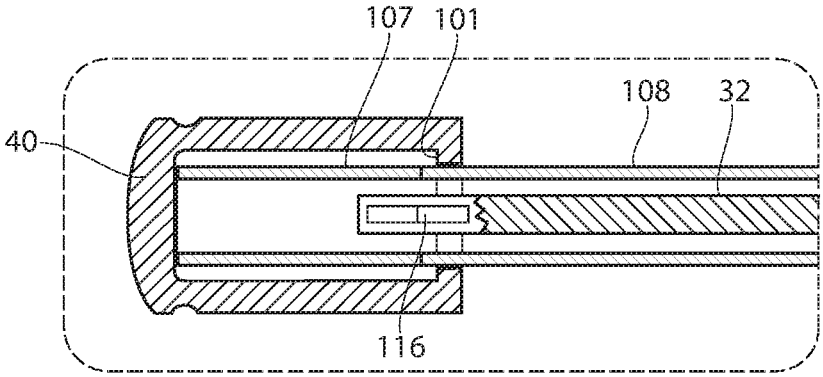
FIG. 15C shows a second embodiment of the invention in a locked position.
Figure 15D:
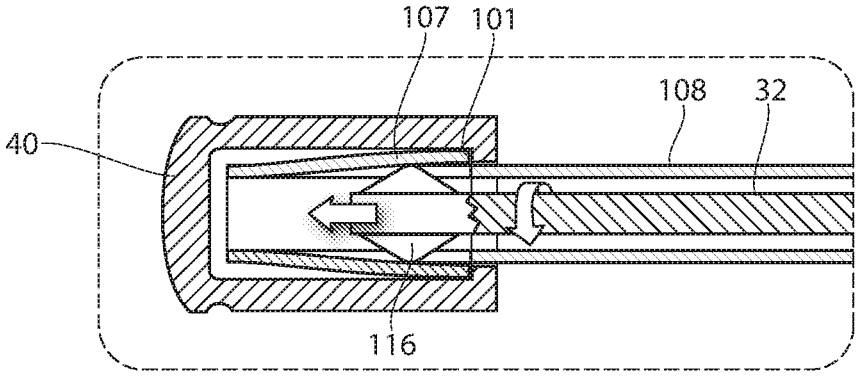
FIG. 15D shows a second embodiment of the invention being unlocked.
Figure 16A:
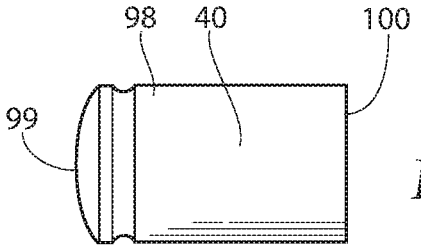
FIGS. 16A-16D show another embodiment of the invention.
Figure 16B:
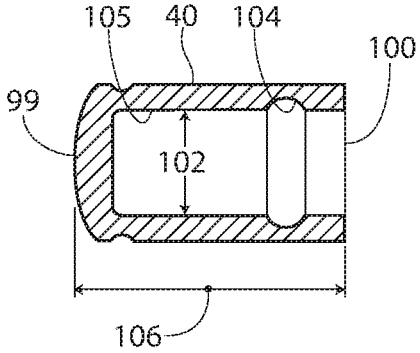
Figure 16C:
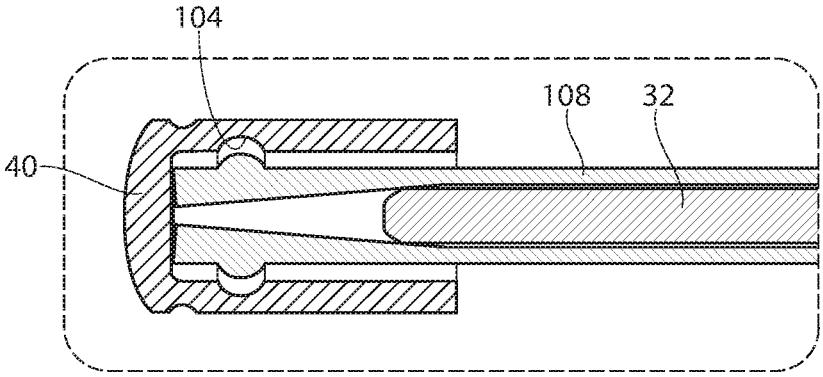
Figure 16D:
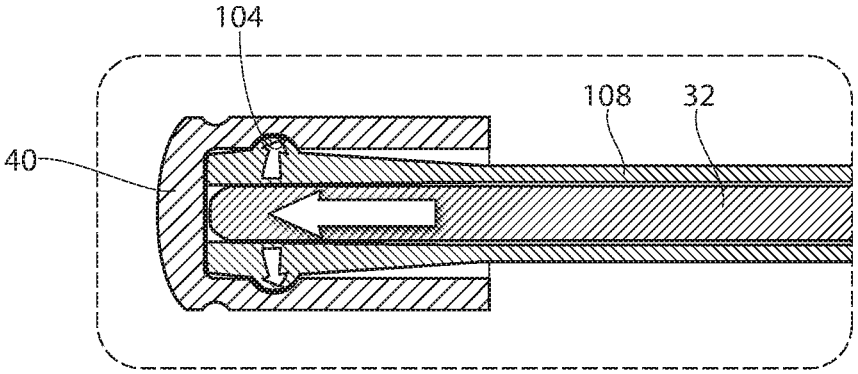
Figure 17A:
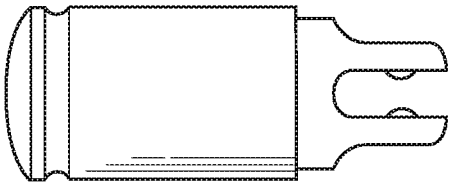
FIGS. 17A-17D show another embodiment of the invention.
Figure 17B:
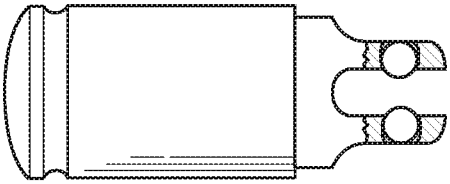
Figure 17C:
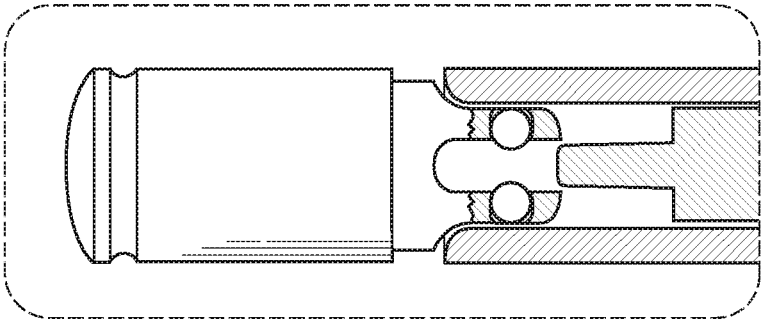
Figure 17D:
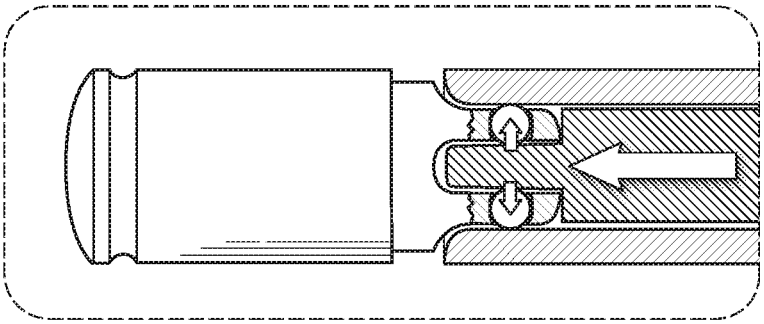
Figure 18A:
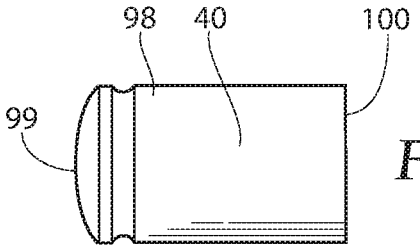
FIGS. 18A-18D show yet another embodiment of the invention.
Figure 18B:
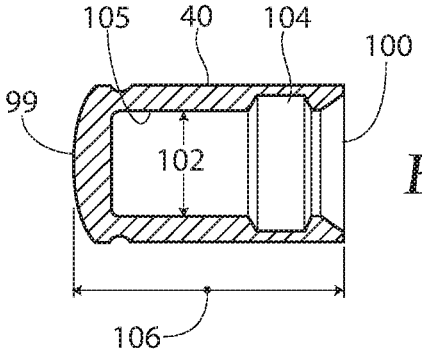
Figure 18C:
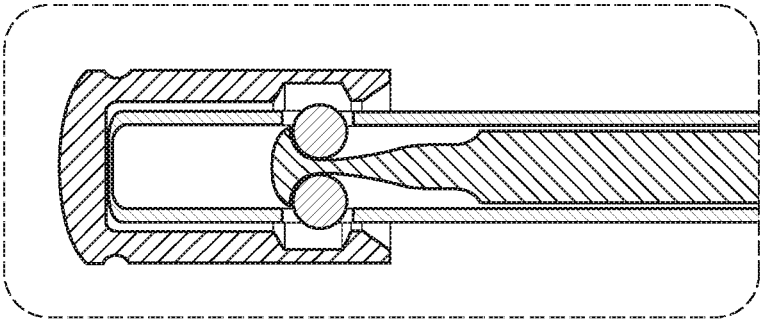
Figure 18D:
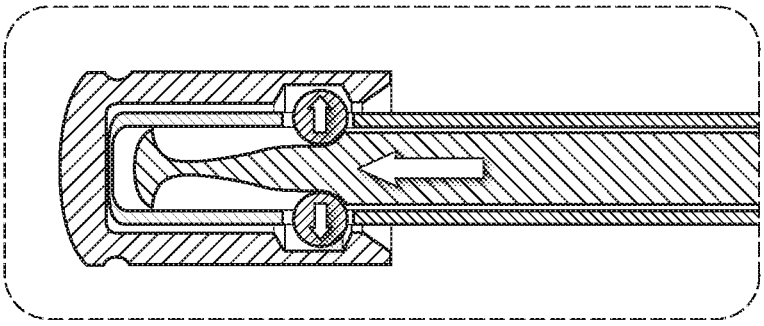

In this embodiment, a pair of wedges akin to the bearing 116 of previous embodiments are inserted into sleeve 108. When wedges 116 are oriented horizontally as seen in FIG. 15C, portions 107 seat against stem sleeve 108 for an unlocked configuration in which stem 32 can be freely removed from safety round 40. When stem 32 and related wedges 116 are turned vertically, as seen in FIG. 15D, portions 107 are moved to a locked position as described supra.

Figure 19A:
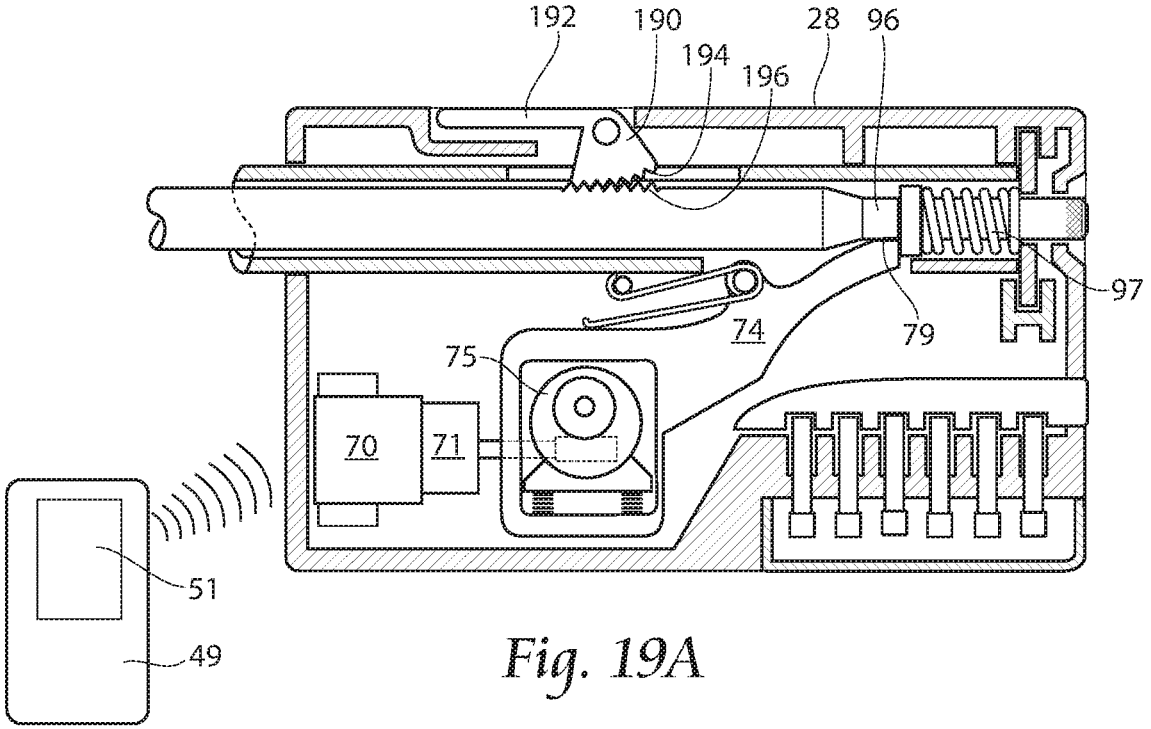
FIGS. 19A and 19B are a side cross-sectional views of another embodiment of the invention in unlocked and locked positions respectively.
Figure 19B:
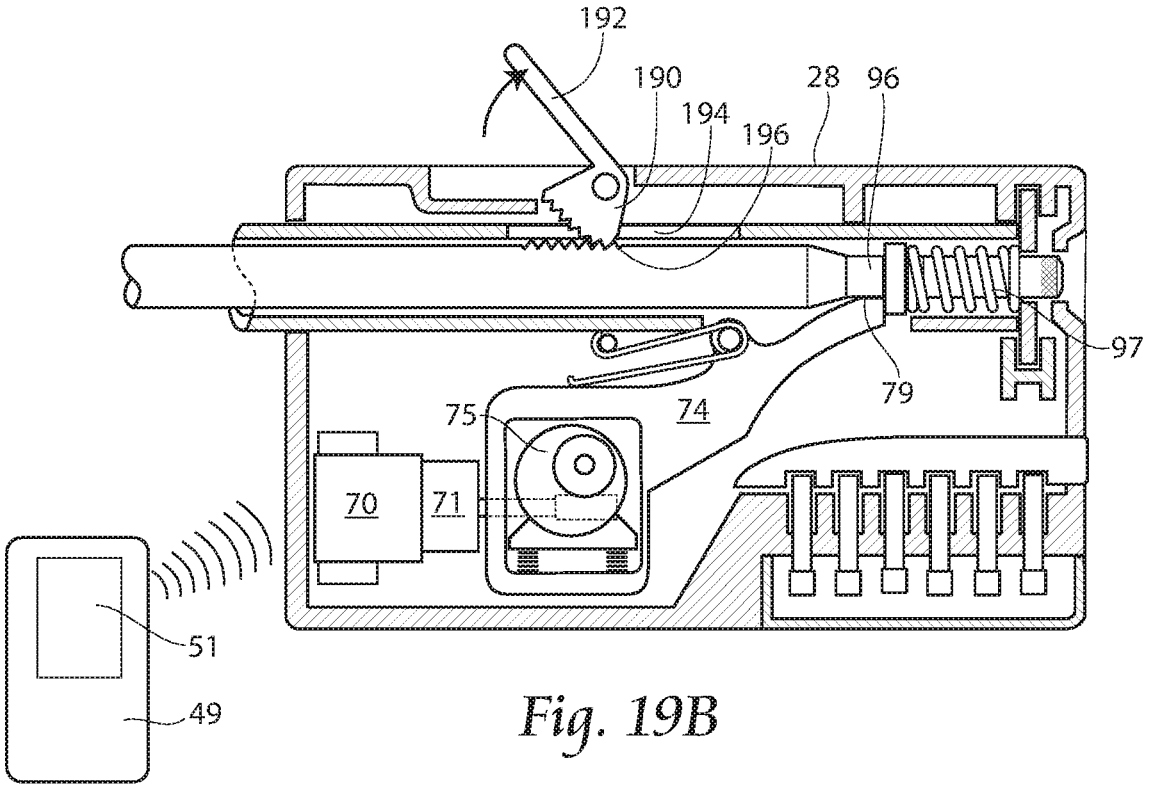
Figure 20:
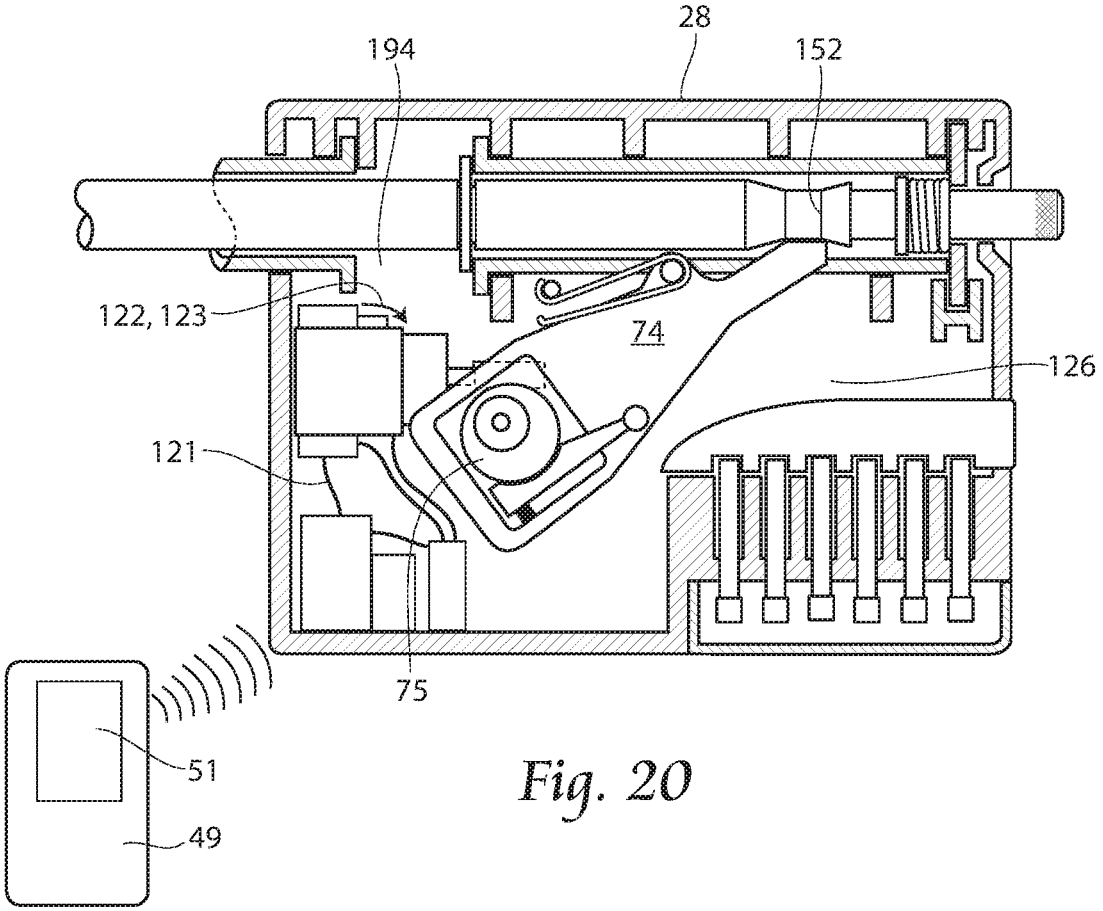
FIG. 20 is a side cross-sectional view of an embodiment of the invention.

FIGS. 19A and 19B show a locked and an unlocked embodiment of the invention in which a lever 190 is present. The lever 190 has a handle 192 that is generally flush with the security housing 28, though a projection or indentation might be used to promote grasping the lever 190. In this embodiment, the working end of the lever 190 bears teeth 194 that couple with the teeth 196 of the stem 32.

In some embodiments, the user pushes the external locking button on the front of the lock which in turn pushes the stem. However, if the interior mechanism were reversed, for example for the sake of economy, the lever 190 would reverse the direction of the stem 32 to lock the assembly 4. This would allow the user to push the lever 190 down but would result in a pull of the stem inside the system. This is important because one hand usability is desirable. The lever would allow the user to insert the lock and push down on the lever with one hand.

Turning to FIGS. 21A-23B, the previously noted adapter 7 is shown (A) as interposed between the firearm 6 and the gun lock 4, and (B) in one of multiple possible embodiments of the adapter 7. The embodiments shown in the figures should be understood as representative, not comprehensive.

DESCRIPTION OF THE PREFERRED EMBODIMENT—METHOD

As shown in FIGS. 9A and 10A, an operator places the RFID transmitter 49 in close proximity to the security assembly 28. At least one of the RFID reader 43 and the RFID reader antenna 62 receives a signal from the RFID transmitter 49. The RFID transmitter 49 returns a signal to at least one of the RFID reader 43 and the RFID reader antenna 62. The RFID reader 43 in turn sends a signal to the control circuit 63, which determines the presence of the signal as an actuation command to the motor 70.

The motor 70 is actuated and, in movable communication with the gearbox 71 and drive shaft 73, sends a rotational motion to the arm actuating assembly 75. The arm actuating assembly 75 rotates the release arm 74. The rotation of the release arm 74 causes the release arm second end 79 to slide from a first position in contact with the stem 32 to a second position in contact with the stem 32.

Specifically referring to the locked position shown in FIGS. 10A and 10B, FIG. 10A shows that the release arm end 79 is resting between the first and second frustoconical portions 93, 95 at second diameter 95. Spring 97 is compressed permitting plate 33 to advance, consequently permitting stem 32 to extend beyond housing 28 as a visual indicator 34. Meanwhile, in FIG. 10B, bearing 116 is trapped between the high end of slope 112 and annular ring 104. This prevents the stem 32 from prematurely separating from the safety round.

Turning to the unlocked position shown in FIGS. 9A and 9B, the release arm end 79 is found at the third diameter 96, having been pushed over the second frustoconical portion 95 by the rotation of arm 74. This permits the spring 97 to expand until the plate 33 stops against end 79.

In an un-locking sequence, the RFID transmitter 49 is applied to charge the stem 32, thus activating the motor 70 and releasing the release arm 74. The release arm 74 permits the spring 97 to urge the plate 33 toward the muzzle 8 such that the locked state indicator 34 is retracted into the security housing 28.

As a result of decompressing the spring 97, the stem 32 is also urged into the chamber sub-system, activating the bearing 116 to roll out of connection with the notch 24. The stem 32 can be turned to be removed from the sleeve. The entire security assembly 4 will fall out of the barrel 10. Ideally, the lock 4 can be unlocked in one second or less.

Note that the range of the antenna 62 can be made variable such that, for example, only a very close exposure of the transmitter 49 to the antenna 62 will deactivate the lock 4. The user then cycles the slide to eject the safety round 40, which in turn may load a live round of ammunition. The user may then shoot live ammunition at a target.

A manual override unit 55 is also provided in case override of the RFID locking apparatus 4 is required. In this case, the user presses the manual override access button 52 to release the access door 91, exposing a manual override unit 55. The user is thus presented with a more traditional button or dial lock 87 that has been coded to the user's preferred combination.

Opening the manual lock 87 permits the override body 89 to move axially such that its distal end, which forms override engagement button 88, can be pushed into the body of security housing 28. As a result, the proximal end of the override body 89 is pushed into engagement with an arm release 77 of the release arm 74, mechanically activating the release arm 74 without use of the control sub-system.

Then, as before, the security assembly 4 releases stem 32, the security assembly 4 falls out of the barrel 10, and the user cycles the slide to eject the safety round 40. If there is ammunition loaded, the user may then shoot live ammunition at a target.

A locking sequence comprises re-insertion of the stem 32 into the safety round 40 and the safety round 40 into the chamber 22 by way of the stem sleeve 108. The stem 32 is then completely seated within the chamber sub-system. A fully inserted safety round 40 can be indicated with an audible and/or visual signal.

To lock the security assembly 4 after a manual override, the override body 89 is also pushed to its locked position, the manual lock 87 is re-scrambled, and manual override unit 55 is closed.

An RFID-optimized method of un-locking is also contemplated.

Numerous variations on the elements and steps recited herein will be obvious to a person of skill in the art, and all such variations should be considered within the scope of the invention.

We claim:

1. A weapon locking device for a weapon, said weapon comprising a barrel and a weapon chamber, said locking device comprising:

a security assembly located in a housing, said security system further comprising an actuating sub-system; and a control sub-system in electrical communication with actuating sub-system to activate the locking device:

a chamber sub-system located in said weapon chamber;

a stem extending from said security housing to said chamber sub-system;

a stem sleeve for securely containing said stem; and a radio-frequency identification (RFID) receiver located within said security housing for locking and unlocking said weapon locking device, wherein the locking device locks said weapon externally of said barrel, wherein the actuating subsystem further comprises:

a release arm in rotational communication with said actuating sub-system, said release arm in biased communication with said stem.

2. The weapon locking device according to claim 1, wherein said chamber sub-system further comprises:

a safety round and a ball bearing, wherein said stem includes a cavity for supporting said ball bearing, said ball bearing interacting with said safety round to secure said stem to said safety round when said device is in a locked position.

3. The weapon locking device according to claim 1 wherein said actuating subsystem further comprises a drive system connected to said release arm, said drive system in electrical communication with said control sub-system.

4. The weapon locking device according to claim 1 further comprising a mechanical override, said override comprising a manual override button;

an override wedge; and a dial lock mechanism in mechanism in communication with said actuating sub-system to lock and unlock said locking device.

* * * * *